US010626558B2

(12) United States Patent
Esser et al.

(10) Patent No.: US 10,626,558 B2
(45) Date of Patent: Apr. 21, 2020

(54) METHOD FOR PRODUCING PAPER

(71) Applicant: SOLENIS TECHNOLOGIES, L.P., Wilmington, DE (US)

(72) Inventors: Anton Esser, Limburgerhof (DE); Hans-Joachim Haehnle, Neustadt (DE)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 61 days.

(21) Appl. No.: 15/747,263

(22) PCT Filed: Aug. 4, 2016

(86) PCT No.: PCT/EP2016/068622
§ 371 (c)(1),
(2) Date: Jan. 24, 2018

(87) PCT Pub. No.: WO2017/021483
PCT Pub. Date: Feb. 9, 2017

(65) Prior Publication Data

US 2018/0216294 A1 Aug. 2, 2018

(30) Foreign Application Priority Data

Aug. 6, 2015 (EP) ..... 15179980

(51) Int. Cl.

| | |
|---|---|
| ***D21H 17/38*** | (2006.01) |
| ***D21H 17/37*** | (2006.01) |
| ***D21H 21/10*** | (2006.01) |
| ***D21H 21/20*** | (2006.01) |
| ***D21H 23/28*** | (2006.01) |
| ***D21H 21/06*** | (2006.01) |
| ***D21H 17/40*** | (2006.01) |
| ***D21H 17/41*** | (2006.01) |
| ***D21H 17/67*** | (2006.01) |
| ***D21H 17/68*** | (2006.01) |
| ***D21J 1/00*** | (2006.01) |

(52) U.S. Cl.
CPC ..... *D21H 17/37* (2013.01); *D21H 17/38* (2013.01); *D21H 17/40* (2013.01); *D21H 17/41* (2013.01); *D21H 17/67* (2013.01); *D21H 17/675* (2013.01); *D21H 17/68* (2013.01); *D21H 21/06* (2013.01); *D21H 21/10* (2013.01); *D21H 21/20* (2013.01); *D21H 23/28* (2013.01); *D21J 1/00* (2013.01)

(58) Field of Classification Search
USPC ..... 162/164.6
See application file for complete search history.

(56) References Cited

U.S. PATENT DOCUMENTS

| | | | |
|---|---|---|---|
| 5,167,766 | A | 12/1992 | Honig et al. |
| 5,171,808 | A | 12/1992 | Ryles et al. |
| 5,176,891 | A | 1/1993 | Rushmere |
| 5,919,682 | A | 7/1999 | Ryles et al. |
| 5,961,840 | A | 10/1999 | Ryles et al. |
| 6,273,998 | B1 | 8/2001 | Kuo et al. |
| 6,524,439 | B2 | 2/2003 | Chen et al. |
| 2002/0066540 | A1 | 6/2002 | Chen et al. |
| 2003/0192664 | A1 | 10/2003 | Kulick et al. |
| 2011/0079365 | A1 | 4/2011 | Haehnle et al. |

FOREIGN PATENT DOCUMENTS

| | | | |
|---|---|---|---|
| DE | 60115692 | T2 | 7/2006 |
| EP | 0041056 | A1 | 12/1981 |
| EP | 0165068 | | 6/1986 |
| EP | 0251182 | A1 | 1/1988 |
| EP | 0235893 | B1 | 5/1990 |
| EP | 0528409 | A1 | 2/1993 |
| EP | 0672212 | B1 | 6/1996 |
| EP | 0780513 | A2 | 6/1997 |
| EP | 0950138 | | 10/1999 |
| WO | 94/13882 | A1 | 6/1994 |
| WO | 2004/087818 | A1 | 10/2004 |
| WO | 2005/012637 | A1 | 2/2005 |
| WO | 2006/066769 | A2 | 6/2006 |
| WO | 2009/156274 | A1 | 12/2009 |
| WO | 2014/029593 | A1 | 2/2014 |

OTHER PUBLICATIONS

U.S. Appl. No. 15/518,514, filed Aug. 17, 2017 2017/0233950 Haehnle et al.
U.S. Appl. No. 15/746,462, filed Jan. 22, 2018 Lange et al.
U.S. Appl. No. 15/536,552, filed Dec. 21, 2017 2017/0362776 Haehnle et al.
International Search Report dated Oct. 28, 2016, in PCT/EP2016/066622, filed Aug. 4, 2016.

*Primary Examiner* — Mark Halpern
(74) *Attorney, Agent, or Firm* — Lorenz & Kopf, LLP

(57) ABSTRACT

A method of producing paper and board by using at least one water-soluble amphoteric polymer is provided. The water-soluble amphoteric polymer is obtained by copolymerizing a monomer mixture containing a) at least one N-vinylcarboxamide, b) at least one monoethylenically unsaturated monomer having at least one free acid group or at least one acid group in salt form, c) optionally at least one monoethylenically unsaturated monomer other than components (a) and (b), and d) optionally at least one compound having two or more ethylenically unsaturated double bonds, and then partly or wholly hydrolyzing the —CO—$R^1$ groups of the polymer. The cationic monomer units and the anionic monomer units differ in their respective molar fractions, each based on the total number of moles of all monomer units, by not more than 10 mol % in absolute terms.

9 Claims, No Drawings

METHOD FOR PRODUCING PAPER

This application is a 371 of PCT/EP2016/068622 filed on 4 Aug. 2016.

The present invention relates to a method of producing paper and board comprising admixing this aqueous slurry to a paper stock, dewatering the paper stock obtained and then pressing the sheet of paper and drying.

The production of paper is a process wherein a solid phase consisting of wood fiber and/or cellulose fiber and various inorganic aggregates is separated from an aqueous phase. The original concentration of the solid phase in the paper stock suspension (thin stuff) is typically in a range between 15 g/l and 1.5 g/l. The separation between the solid and aqueous phases is effected in two or more steps and can be modulated within these steps through the choice of mechanical parameters or through the precise admixture of chemical additives. The first step comprises dewatering the paper stock by spraying onto a wire and/or by injecting between two wires which are referred to as the bottom wire and the top wire, respectively, depending on their position relative to the injected paper stock. Depending on the layout of the so-called wire section, the water is separated from the paper stock through the force of gravity alone or through a combination of the force of gravity and centrifugal forces and drains away through the wire apertures.

An important part in wire dewatering is also played by the employment of chemical additives known as retention and drainage aids. They include in particular high molecular weight, slightly cationic polyacrylamides, cationic starch but also polymers based on vinylformamide and ethyleneimine. U.S. Pat. No. 6,273,998 describes the use of vinylamine copolymers in combination with microparticles such as bentonite as a retention aid added to the paper stock in the wet end process.

EP-A-950138 teaches the two-step treatment of paper stock with a cationic polymer and microparticles and, after shearing has been applied in the second step, with a cross-linked anionic polymer.

WO-A-04/087818, WO-A-05/012637 and WO-A-2006/066769 describe aqueous slurries of finely divided fillers treated with water-soluble amphoteric copolymers based on polyvinylamine. These slurries make possible an increase in the filler content of papers without sacrificing paper properties such as dry strength in particular.

The dry matter content obtained in the wire section depends not only on the mechanical conditions in the wire section and the choice of chemical additives but also, very substantially, on the paper stock system and the basis weight of the paper web. While efficient dewatering of the paper stock is the primary purpose, the paper shall also have good final properties. Overfast dewatering can lead to premature immobilization of paper fibers and hence to poor strength properties or to poor visual properties.

The so-called initial wet web strength IWWS is another important property dependent on the dry matter content of the paper web. The initial wet web strength must not be confused with a paper's wet strength and initial wet strength, since both properties are measured on dried paper remoistened back to a defined water content. Initial wet web strength is the strength of a never-dried paper. It is the strength of a wet as-produced paper after passing through the wire and press sections of the papermachine. The water content is typically about 50%. Increased initial wet web strength permits application of higher pull-off forces and hence faster papermachine operation (cf. EP-A-0 780 513) or the use of larger amounts of filer.

WO 2009/156274 teaches the use of amphoteric copolymers obtainable by copolymerization of N-vinylcarbaxamide with anionic comonomers and subsequent hydrolysis of the vinylcarboxamide as a paper stock additive for enhancing the initial wet web strength of paper. The treatment takes place at the thick stuff stage or at the thin stuff stage in the paper production process for example.

WO 2014/029593 teaches a method of producing paper having high initial wet web strength by adding a water-soluble amphoteric copolymer obtained by Hofmann degradation of an acrylamide- and/or methacrylamide-containing polymer and pressing the paper sheet formed in the press section to a defined solids content of ≥48 wt %.

It is an object of the present invention to enhance the initial wet web strength of as-produced paper prior to transitioning into the dryer section in order to achieve higher machine speeds in the paper production process compared with existing processes.

We have found that this object is achieved by a method of producing paper and board, said method comprising providing an aqueous slurry comprising a filler, at least one water-soluble amphoteric polymer and a microparticle, admixing this aqueous slurry to a paper stock, dewatering the paper stock obtained, by sheet formation in the wire section, until the page sheet has a dry matter content of not less than 18 wt %, and then pressing the paper sheet and drying, wherein the water-soluble amphoteric polymer is obtainable by copolymerizing a monomer mixture comprising a) at least one N-vinylcarboxamide of the general formula

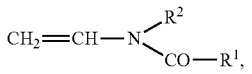

(I)

where $R^1$ and $R^2$ are each independently H or $C_1$ to $C_6$ alkyl, b) at least one monoethylenically unsaturated monomer having at least one free acid group or at least one acid group in salt form, c) optionally at least one monoethylenically unsaturated monomer other than said components (a) and (b), and d) optionally at least one compound having two or more ethylenically unsaturated double bonds in the molecule, and then partly or wholly hydrolyzing the —CO—$R^1$ groups of the polymer, wherein the cationic monomer units and the anionic monomer units differ in their respective molar fractions, each based on the total number of moles of ail monomer units, by not more than 10 mol % in absolute terms.

It was found that the dry matter content of the paper web at the end of the wire section and before the mechanical operation of pressing has substantial influence on the effect of filler treatment with a multicomponent system.

Nomenclature for the shaped article consisting of fibrous material varies with said article's mass per unit area, also known in the art as the basis weight. In what follows, paper and board refer respectively to a mass per unit area of 7 g/m$^2$ to 225 g/m$^2$ and 225 g/m$^2$ or more.

Furnish (also known as paper stock) hereinafter refers to a mixture of materials which consists of one or more species of fiber, filler and of various auxiliaries as a suspension in water and at a stage prior to sheet formation.

Total paper stock is the furnish following addition of all filler slurries and auxiliaries. Dry total paper stock, also referred to as total paper stock solids, is to be understood as meaning the matter resulting from the dry matter content determination to DIN EN ISO 638 DE.

Fillers are provided as a so-called aqueous slurry and mixed with the remaining furnish. The term filler herein comprehends any pigments customarily usable in the paper industry which are based on metal oxides, silicates and/or carbonates and have a BET specific surface area of ≤20 $m^2/g$. Preference is given to pigments from the group consisting of calcium carbonate, as which ground calcium carbonate (GCC), chalk, marble or precipitated calcium carbonate (PCC) can be used, talcum, kaolin, bentonite, satin white, calcium sulfate, barium sulfate and titanium dioxide. Mixtures of two or more pigments are also usable. Particular preference for use as fillers is given to calcium carbonate, not only in the form of ground calcium carbonate, chalk and marble, but also in the form of precipitated calcium carbonate.

Filler in the context of this invention is to be understood as particles having an average particle size (volume average) ≤10 μm, preferably in the range from 0.3 to 5 μm and particularly in the range from 0.5 to 2 μm. Average particle size (volume average) is generally quantified herein for fillers by the method of quasi-elastic light scattering (DIN-ISO 13320-1) using, for example, a Mastersizer 2000 from Malvern Instruments Ltd. Fillers generally have a BET specific surface area of ≤20 $m^2/g$.

Aqueous slurry is to be understood as a composition comprising filler, generally to a filler content of ≥5 wt %, based on the aqueous slurry. The filler content of the slurry is preferably in the range from 10 to 70 wt %, in particular from 20 to 60 wt %.

The aqueous slurry of filler may further also comprise additional organic or inorganic auxiliaries.

The invention provides an aqueous slurry comprising at least an inorganic filler, a water-soluble amphoteric polymer and a microparticle.

The water-soluble amphoteric polymer is obtainable by copolymerizing the monomer mixture comprising monomers a) and b) and then wholly or partly hydrolyzing the —CO—$R_1$ groups of the polymer. The monomer composition and the degree of hydrolysis are chosen such that the cationic monomer units and the anionic monomer units differ in their respective molar fractions, each based on the total number of moles of all monomer units, by not more than 10 mol % in absolute terms.

The water-soluble amphoteric polymers comprise the following structural units:

amidine units (II)

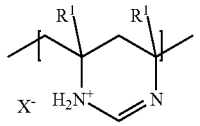

(III)

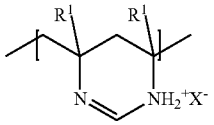

amine units (VI)

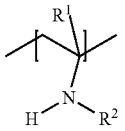

where the substituents $R^1$ and $R^2$ in the formulae II, II and VI are each as defined in formula I and $X^-$ is an anion in formulae II and III, and units of ethylenically unsaturated acids of group (b) in the form of free acids and/or in salt form.

The ratio of amidine units to amine units in the hydrolyzed copolymers is, for example, in the ratio from 100:1 to 1:30, preferably from 40:1 to 1:15, more preferably from 8:1 to 1:8.

Cationic units in this context are to be understood as the sum total of amine and amidine units, while anionic units subsume the acid units which are formed in the copolymerization from the monomers of group (b) and which are in the form of free acid groups and/or in salt form.

Examples of group (a) monomers are open-chain N-vinylamide compounds of formula (I) such as, for example, N-vinylformamide, N-vinyl-N-methylformamide, N-vinylacetamide, N-vinyl-N-methylacetamide, N-vinyl-N-ethylacetamide, N-vinylpropionamide and N-vinyl-N-methylpropionamide and N-vinylbutyramide. The monomers of group (a) can be used singly or mixed in the copolymerization with the monomers of the other groups. It is preferably N-vinylformamide which is used in the copolymerization from this group.

The copolymers to be used according to the present invention comprise at least one group (b) monomer which is a monoethylenically unsaturated monomer having at least one free acid group or at least one acid group in salt form.

The acid group may be present as free acid group or in salt form. Preferred salts are the water-soluble salts such as alkali metal, alkaline earth metal or ammonium salts.

Suitable bases for partly or wholly neutralizing the acid groups of monomers (b) are, for example, alkali metal or alkaline earth metal bases, ammonia, amines and/or alkanolamines. Examples thereof are sodium hydroxide, potassium hydroxide, sodium carbonate, potassium carbonate, sodium bicarbonate, potassium bicarbonate, magnesium hydroxide, magnesium oxide, calcium hydroxide, calcium oxide, triethanolamine, ethanolamine, morpholine, diethylene-triamine or tetraethylenepentamine.

Suitable monomers of this group (b) are, for example, monoethylenically unsaturated sulfonic acids, phosphonic acids, monocarboxylic acids and dicarboxylic acids and also the salts of each. Further suitable are monoethylenically unsaturated monoesters of phosphonic acids, monoamides of phosphonic acids, and dicarboxylic anhydrides. Suitable monomers (b) further include esters of phosphoric acid with alcohols having a polymerizable, α,β-ethylenically unsaturated double bond. One proton of the phosphoric acid group or both the remaining protons of the phosphoric acid group may be neutralized by suitable bases. A further acid function may additionally be esterified with alcohols that have no polymerizable double bonds.

Suitable saturated alcohols to esterify phosphoric acid are, for example, $C_1$-$C_6$ alkanols, for example methanol, ethanol, n-propanol, isopropanol, n-butanol, sec-butanol, tert-butanol, n-pentanol, n-hexanol and also isomers thereof.

Useful group (b) monomers include, for example, monoethylenically unsaturated carboxylic acids having 3 to 8 carbon atoms and also the water-soluble salts such as alkali metal, alkaline earth metal or ammonium salts of these carboxylic acids. This group of monomers includes, for example, acrylic acid, methacrylic acid, dimethacrylic acid, ethacrylic acid, α-chloroacrylic acid, maleic acid, maleic anhydride, fumaric acid, itaconic acid, mesaconic acid, citraconic acid, glutaconic acid, aconitic acid, methylenemalonic acid, allylacetic acid, vinylacetic acid and crotonic acid. The dicarboxylic anhydrides of the abovementioned acids are further suitable.

Monomers (b) further include, for example, vinylsulfonic acid, allylsulfonic acid, methallylsulfonic acid, sulfoethyl acrylate, sulfoethyl methacrylate, sulfopropyl acrylate, sulfopropyl methacrylate, 2-hydroxy-3-acryloyloxypropylsulfonic acid, 2-hydroxy-3-methacryloyloxypropylsulfonic acid, styrenesulfonic acid, acrylamidomethylenephosphonic acid, 2-acrylamido-2-methylpropane-sulfonic acid, vinylphosphonic acid, N-vinylaminomethylenephosphonic acid ($CH_2{=}CH{-}NH{-}CH_2{-}PO_3H$), monomethyl vinylphosphonate, allylphosphonic acid, monomethyl allylphosphonate, acrylamidomethylpropylphosphonic acid, (meth)acryloylethylene glycol phosphate and monoallyl phosphate.

The aforementioned monomers (b) are employable singly or in the form of any mixtures.

The copolymers may optionally comprise at least one further monomer of group (c) in polymerized form for modification. These monomers are preferably nitriles of α,β-ethylenically unsaturated mono- and dicarboxylic acids, for example acrylonitrile and methacrylonitrile. Copolymers of this type then hydrolyze to 5 ring amidines.

Suitable monomers of group (c) further include:

esters of α,β-ethylenically unsaturated mono- and dicarboxylic acids with monohydric $C_1$-$C_{30}$ alkanols, $C_2$-$C_{30}$ alkanediols and $C_2$-$C_{30}$ aminoalcohols, amides of α,β-ethylenically unsaturated monocarboxylic acids and their N-alkyl and N,N-dialkyl derivatives, esters of vinyl alcohol and allyl alcohol with $C_1$-$C_{30}$ monocarboxylic acids, N-vinyllactams, nitrogen-containing heterocycles and lactones having α,β-ethylenically unsaturated double bonds, vinylaromatics, vinyl halides, vinylidene halides, $C_2$-$C_8$ monoolefins and mixtures thereof.

Representatives of this group (c) include, for example, methyl (meth)acrylate (the formulation "(meth)acrylate" is in each case to be understood as meaning "methacrylate" as well as "acrylate", methyl ethacrylate, ethyl (meth)acrylate, ethyl ethacrylate, n-butyl (meth)acrylate, isobutyl (meth) acrylate, tert-butyl (meth)acrylate, tert-butyl ethacrylate, n-octyl (meth)acrylate, 1,1,3,3-tetramethylbutyl (meth)acrylate, ethylhexyl (meth)acrylate and mixtures thereof.

Suitable additional monomers (c) further include the esters of α,β-ethylenically unsaturated mono- and dicarboxylic acids with aminoalcohols, preferably $C_2$-$C_{12}$ aminoalcohols. The latter may be $C_1$-$C_8$ monoalkylated or dialkylated on the amine nitrogen. The acid component in these esters is suitably, for example, acrylic acid, methacrylic acid, fumaric acid, maleic acid, itaconic acid, crotonic acid, maleic anhydride, monobutyl maleate and mixtures thereof. Preference is given to using acrylic acid, methylacrylic acid and mixtures thereof. Examples thereof include N-methylaminomethyl (meth)acrylate, N-methylaminoethyl (meth) acrylate, N,N-dimethylaminomethyl (meth)acrylate, N,N-dimethylaminoethyl (meth)acrylate, N,N-diethylaminoethyl (meth)acrylate, N,N-dimethylaminopropyl (meth)acrylate, N,N-diethylaminopropyl (meth)acrylate and N,N-dimethylaminocyclohexyl (meth)acrylate.

Suitable additional monomers (c) further include acrylamide, methacrylamide, N-methyl (meth)acrylamide (the formulation " . . . (meth)acrylamide" is to be understood as meaning both " . . . acrylamide" and " . . . methacrylamide"), N-ethyl(meth)acrylamide, n-propyl(meth)acrylamide, N-(n-butyl)(meth)acrylamide, tert-butyl(meth)acrylamide, n-actyl (meth)acrylamide, 1,1,3,3-tetramethylbutyl (meth)acrylamide, ethylhexyl(meth)acrylamide and mixtures thereof.

Suitable monomers (c) further include 2-hydroxyethyl (meth)acrylate, 2-hydroxyethyl ethacrylate, 2-hydroxypropyl (meth)acrylate, 3-hydroxypropyl (meth)acrylate, 3-hydroxybutyl (meth)acrylate, 4-hydroxybutyl (meth)acrylate, 6-hydroxyhexyl (meth)acrylate and mixtures thereof.

Useful further monomers (c) further include N-[2-(dimethylamino)ethyl]acrylamide, N-[2-(di-methylamino)ethyl] methacrylamide, N-[3-(dimethylamino)propyl]acrylamide, N-[3-(dimethyl-amino)propyl]methacrylamide, N-[4-(dimethylamino)butyl]acrylamide, N-[4-(dimethylamino)-butyl] methacrylamide, N-[2-(diethylamino)ethyl]acrylamide, N-[2-(diethylamino)ethyl]-methacrylamide and mixtures thereof.

Suitable monomers (c) further include N-vinyllactams and their derivatives which may, for example, have one or more $C_1$-$C_6$ alkyl substituents (as defined above). These include N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam and mixtures thereof.

Esters of vinyl alcohol and alkyl allyl alcohol with $C_1$-$C_{30}$ monocarboxylic acids are likewise suitable.

Suitable monomers (c) further include N-vinylimidazoles and alkylvinylimidazoles, in particular methylvinylimidazoles such as, for example, 1-vinyl-2-methylimidazole, 3-vinylimidazole N-oxide, 2- and 4-vinylpyridine N-oxides and also betaine derivatives and quaternization products thereof.

Suitable additional monomers further include ethylene, propylene, isobutylene, butadiene, styrene, α-methylstyrene, vinyl acetate, vinyl propionate, vinyl chloride, vinylidene chloride, vinyl fluoride, vinylidene fluoride and mixtures thereof.

The aforementioned monomers (c) are employable singly or in the form of any mixtures.

Further modification of the copolymers is possible by copolymerizing with monomers of group (d), which comprise two or more double bonds in the molecule, e.g., triallylamine, methylenebis-acrylamide, glycol diacrylate, glycol dimethacrylate, glycerol triacrylate, pentaerythritol triallyl ether, at least diacrylated and/or -methacrylated polyalkylene glycols or polyols such as pentaerythritol, sorbitol or glucose. Likewise suitable are allyl and vinyl ethers of polyalkylene glycols or polyols such as pentaerythritol, sorbitol or glucose. When at least one monomer of group (d) is used in the copolymerization, the amounts employed range up to 2 mol %, for example from 0.001 to 1 mol %.

One preferred embodiment polymerizes a monomer mixture having at least one monoethylenically unsaturated monomer as component (b) that is selected from the group consisting of monocarboxylic acids, dicarboxylic acids and dicarboxylic anhydrides, this monomer having at least one free acid group or at least one acid group in salt form.

A further preferred embodiment polymerizes a monomer mixture whose monoethylenically unsaturated monomer with at least one free acid group or at least one acid group in salt form (component (b)) is selected from the group consisting of sulfonic acids, phosphonic acids, monoesters of phosphonic acids, monoamides of phosphonic acids and esters of phosphonic acid with alcohols having a polymerizable α,β-ethylenically unsaturated double bond.

Typical water-soluble amphoteric polymers are obtainable by copolymerizing a monomer composition and then partly or wholly hydrolyzing the —CO—$R^1$ groups of the polymer, the monomer composition consisting of a) 1 to 99 wt %, preferably 5 to 95 wt %, in particular 20 to 90 wt %, based on the total weight of the monomers used for polymerization, at least one N-vinylcarboxamide of the general formula (I)

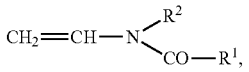

where $R^1$ and $R^2$ are each independently H or $C_1$ to $C_6$, alkyl, b) 1 to 99 wt %, preferably 5 to 95 wt %, in particular 10 to 80 wt %, based on the total weight of the monomers used for polymerization, at least one monoethylenically unsaturated monomer having at least one free acid group or at least one acid group in salt form, preferably at least one monomer selected from the group consisting of monocarboxylic acids, dicarboxylic acids and dicarboxylic anhydrides, c) 0 to 90 wt %, preferably 0.1 to 85 wt %, in particular 1 to 80 wt %, based on the total weight of the monomers used for polymerization, at least one monoethylenically unsaturated monomer other than said components (a) and (b), and d) 0 to 5 wt %, preferably 0.0001 to 3 wt %, based on the total weight of the monomers used for polymerization, at least one compound having two or more ethylenically unsaturated double bonds in the molecule.

The preference is, for example, for such water-soluble amphoteric polymers as are obtainable by copolymerizing a) at least one N-vinylcarboxamide of the general formula (I)

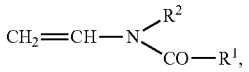

where $R^1$ and $R^2$ are each independently H or $C_1$ to $C_6$ alkyl, b) at least one monomer, which is selected from monoethylenically unsaturated $C_3$-$C_8$ carboxylic acids and water-soluble salts thereof, such as alkali metal and alkaline earth metal and ammonium salts thereof, c) optionally at least one monoethylenically unsaturated monomer other than said components (a) and (b), and d) optionally at least one compound having two or more ethylenically unsaturated double bonds in the molecule, and then partly or wholly hydrolyzing the —CO—$R^1$ groups from the polymerized form of monomers (a) in the copolymer.

The particular preference is for such water-soluble amphoteric polymers as are obtainable by copolymerizing a) N-vinylformamide, b) acrylic acid, methacrylic acid and/or their alkali metal or ammonium salts, and c) optionally other monoethylenically unsaturated monomers and then eliminating the —CO—$R^1$ group from the copolymers.

The polymers obtained by the method described above are hydrolyzed in a known manner via agency of acids, bases or enzymes, for example hydrochloric acid, aqueous sodium hydroxide solution or aqueous potassium hydroxide solution. This eliminates the —CO—$R^1$ group from the polymerized units of monomers (a) having the above-displayed formula (I) to leave copolymers having vinylamine units (VI) and/or amidine units (II-V)

(VI)

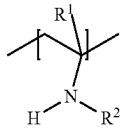

(II)

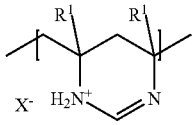

(III)

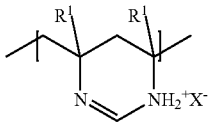

(IV)

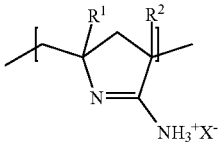

(V)

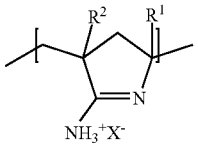

where $X^-$ is an anion in each of amidine units (II) to (V) and the substituents $R^1$ and $R^2$ in formulae II-VI are each as defined in formula I.

The originally anionic copolymer acquires cationic groups in the hydrolysis and thus is rendered amphoteric.

Amidine units (II) and (III) are the result of adjacent vinylamine units of formula (VI) reacting with vinylformamide units and those of formulae IV and V are the result of adjacent vinylamine units of formula (VI) reacting with acrylonitrile or methacrylonitrile groups (if present in the polymer).

The hydrolysis of the copolymers has been disclosed in detail, for example in EP-B-0 672 212 at page 4 lines 38-58 and at page 5 lines 1-25 and in the examples of EP 528 409.

Preference is given to using an amphoteric polymer where the hydrolysis was carried out in the presence of bases, preferably in the presence of aqueous sodium hydroxide solution. Preference is given to partially and fully hydrolyzed polymers having a ≥10 mol %, preferably ≥20 mol % and especially ≥30 mol % degree of hydrolysis. Their degree of hydrolysis is synonymous with the polymers' combined content of primary amino groups and amidine groups when it is expressed, on a molar basis, as a percentage of the N-vinylcarboxamide units originally present.

The amphoteric polymer comprises for example (i) 1 to 98 mol %, preferably 1 to 75 mol % of vinylcarboxamide units, (ii) 1 to 98 mol %, preferably 1 to 55 mol % of units of monoethylenically unsaturated sulfonic acids, phosphonic acids, phosphoric esters, derivatives thereof or units of monoethylenically unsaturated mono- and dicarboxylic acids, their salts and dicarboxylic anhydrides, preferably 1 to 98 mol %, more preferably 1 to 55 mol % of units of at least one monoethylenically unsaturated carboxylic acid having 3 to 8 carbon atoms, (iii) 1 to 98 mol %, preferably 1 to 55 mol % of vinylamine units of formula (VI) and/or amidine units of formulae (II), (III), (IV) and/or (V), and (iv) up to 50 mol % of units of other monoethylenically unsaturated compounds.

Particular preference is given to amphoteric polymers comprising, in particular consisting of, (i) 5 to 70 mol % of vinylcarboxamide units, (ii) 3 to 30 mol % of units of monoethylenically unsaturated sulfonic acids, phosphonic acids and salts thereof, and (iii) 10 to 60 mol % of vinylamine units of formula VI in salt form and optionally amidine units of formulae (II) and/or (III).

The particular preference in a further embodiment is for amphoteric polymers comprising, in particular consisting of, (i) 5 to 70 mol % of vinylcarboxamide units, (ii) 5 to 45 mol % of units of acrylic acid, methacrylic acid, salts and mixtures thereof, and (iii) 10 to 60 mol % of vinylamine units of formula VI in salt form and/or amidine units of formulae (II) and/or (III).

Those amphoteric copolymers which comprise polymerized units of N-vinylformamide as component (a) are of particular industrial significance in all the embodiments mentioned above.

The water-soluble amphoteric polymers are obtainable in a conventional manner known to a person skilled in the art. Examples of suitable methods are described in EP-A-0 251 182, WO-A-94/13882 and EP-B-0 672 212, which are incorporated herein by reference. Reference is further made to the preparation of the water-soluble amphoteric polymers described in WO-A-04/087818 and WO-A-05/012637.

The water-soluble amphoteric polymers are obtainable via solution, precipitation, suspension or emulsion polymerization. Solution polymerization in aqueous media is preferable. Suitable aqueous media are water and mixtures of water with at least one water-miscible solvent, for example with an alcohol, such as methanol, ethanol, n-propanol, isopropanol, etc.

Polymerization temperatures are preferably in a range of about 30 to 200° C., more preferably 40 to 110° C. The polymerization is typically carried out under atmospheric pressure, but it may also be carried out under reduced or superatmospheric pressure. A suitable pressure range extends from 0.1 to 5 bar.

The acid-functional monomers (b) are preferably employed in salt form. The copolymerization pH is preferably established in the range from 6 to 9. The pH may be kept constant during the polymerization by employing a customary buffer or by measuring the pH and admixing an acid or a base as appropriate.

To polymerize the monomers into polymers, initiators that form free radicals may be used.

Useful initiators for free-radical polymerization include the customary peroxo and/or azo compounds for this, examples being alkali metal or ammonium peroxodisulfates, diacetyl peroxide, dibenzoyl peroxide, succinyl peroxide, di-tert-butyl peroxide, tert-butyl perbenzoate, tert-butyl perpivalate, tert-butyl peroxy-2-ethylhexanoate, tert-butyl permaleate, cumine hydroperoxide, diisopropyl peroxidicarbamate, bis(o-toluoyl) peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide, azo-bis-isobutyronitrile, azo-bis(2-amidonopropane) dihydrochloride or 2-2'-azo-bis(2-methylbutyronitrile). Also suitable are initiator mixtures or redox initiator systems, examples being ascorbic acid/iron(II) sulfate/sodium peroxodisulfate, tert-butyl hydroperoxide/sodium disulfite, tert-butyl hydroperoxide/sodium hydroxymethanesulfinate, $H_2O_2$/CuI.

The polymerization may be carried out in the presence of at least one chain transfer agent to control the molecular weight. Useful chain transfer agents include the customary compounds known to a person skilled in the art, such as sulfur compounds, e.g. mercaptoethanol, 2-ethylhexyl thioglycolate, thioglycolic acid, sodium hypophosphite, formic acid or dodecyl mercaptan and also tribromochloromethane or other compounds that have a controlling effect on the molecular weight of the polymers obtained.

The average molar mass $M_w$ of the water-soluble amphoteric polymer is for example at least 10 000, preferably at least 100 000 daltons and more particularly at least 500 000 daltons. The molar masses of the polymers are then for example in the range from 10 000 to 10 million and preferably in the range from 100 000 to 5 million (as determined by light scattering, for example, on their non-hydrolyzed precursor). This molar mass range corresponds for example to K values of 5 to 300, preferably 10 to 250 (as determined after H. Fikentscher in 5% aqueous sodium chloride solution at 25° C. and a polymer concentration of 0.1 wt %).

Microparticles are further constituents of the aqueous slurry.

The microparticle in question may be not only organic but also inorganic in character.

Suitable polymeric microparticles comprise anionic, cationic or amphoteric organic microparticles. These organic polymers have a limited solubility in water and may be in a crosslinked state. Organic microparticles have an unswollen particle size below 750 nm.

Anionic organic microparticles as described for example in U.S. Pat. No. 6,524,439 are obtainable by hydrolyzing an acrylamide polymer microparticle or by polymerizing anionic monomers such as (meth)acrylic acid and also its salts, 2-acrylamido-2-methylpropanesulfonate, sulfoethyl (meth)acrylate, vinylsulfonic acid, styrenesulfonic acid, maleic acid or other dibasic acids or their salts and also mixtures thereof.

These anionic monomers may further have been copolymerized with nonionic monomers such as (meth)acrylamide, N-alkylacrylamides, N,N-dialkylacrylamides, methyl (meth)acrylate, acrylonitrile, N-vinylmethylacetamide, N-vinylmethylformamide, vinyl acetate, N-vinylpyrrolidone and mixtures thereof.

Cationic organic microparticles as described for example in U.S. Pat. No. 6,524,439 are obtainable by polymerization of monomers such as diallyldialkylammonium halides, acryloyloxyalkyltrimethylammonium chlorides, (meth)acrylates of dialkylaminoalkyl compounds, their salts and also their quaternary compounds, and of monomers such as N,N-dialkylamino-alkyl(meth)acrylamides, (meth)acrylamidopropyltrimethylammonium chloride and of N,N-dimethylaminoethyl acrylate, their acids or quaternary salts or the like.

These cationic monomers may further have been copolymerized with nonionic monomers such as (meth)acrylamide, N-alkylacrylamides, N,N-dialkylacrylamides, methyl (meth)acrylate, acrylonitrile, N-vinylmethylacetamide, N-vinylmethylformamide, vinyl acetate, N-vinylpyrrolidone and mixtures thereof.

Amphoteric organic microparticles are obtainable by polymerizing at least one anionic monomer and also at least one cationic monomer and optionally one or more nonionic monomers of the type described above for the other microparticles.

The polymerization of the monomers to form microparticles is typically carried out in the presence of a polyfunctional crosslinker. Crosslinkers of this type are described for example in U.S. Pat. No. 6,524,439, and have two or more double bonds or one double bond and one reactive group, or two reactive groups. Examples are N,N-methylenebis(meth) acrylamide, polyethylene glycol di(meth)acrylate, N-vinylacrylamide, divinylbenzene, triallylammonium salts, N-methylallyl-acrylamide, glycidyl (meth)acrylate, acrolein, methylolacrylamide, dialdehydes such as glyoxal, diepoxy compounds and also epichlorohydrin.

The polyfunctional crosslinker is used in an amount that results in a sufficiently crosslinked polymer. Thus, at least 4 ppm of polyfunctional crosslinker are used per one mole of monomers. The amount of polyfunctional crosslinker used per one mole of monomers is preferably in the range from 4 to 6000 ppm, more preferably from 20 to 4000 ppm and especially from 40 to 2000 ppm.

The polymerization may be carried out in the presence of at least one chain transfer agent to control the molecular weight. Such polymerizations for preparing polymer particles are described for example in U.S. Pat. Nos. 5,961,840, 5,919,882, 5,171,808 and 5,167,766.

Useful chain transfer agents include the customary compounds known to a person skilled in the art, e.g. sulfur compounds, e.g. mercaptoethanol, 2-ethylhexyl thioglycolate, thioglycolic acid, sodium hypophosphite, formic acid or dodecyl mercaptan and also tribromochloromethane or other compounds that have a controlling effect on the molecular weight of the polymers obtained.

The polymerization to form a microparticle is typically carried out by inverse emulsion polymerization or inverse microemulsion polymerization and is common general knowledge among those skilled in the art. Polymerizations of this type are described for example in US 2003/0192664 (page 6), the teaching of which is expressly incorporated herein by reference.

The microparticles are generally prepared by a) preparing a W/O emulsion having an oil phase as continuous phase and an aqueous discontinuous phase by emulsifying an aqueous solution of the monomers in a hydrocarbon in the presence of a surfactant, and b) conducting a free-radical polymerization.

Preference is given to anionic organic microparticles, in particular copolymers of acrylamide and one or more anionic monomers.

Preferred anionic organic microparticles have an unswollen average particle diameter of ≤750 nm, preferably of ≤500 nm, more preferably in the range from 25 to 300 nm.

The anionic organic microparticles preferably comprise 0-99 parts by weight of a nonionic monomer, 1-100 parts by weight of an anionic monomer, all based on the total weight of all monomers.

The anionic organic microparticles more preferably comprise 10-90 parts by weight of a nonionic monomer, 10-90 parts by weight of an anionic monomer, all based on the total weight of all monomers.

The anionic organic microparticles more preferably comprise 20-80 parts by weight of a nonionic monomer, 20-80 parts by weight of an anionic monomer, all based on the total weight of all monomers.

The anionic organic microparticles have a charge density of at least 2 meq/g. A suitable charge density is in the range from 2 to 18 meq/g, preferably from 3 to 15 meq/g, in particular from 5 to 12 meq/g.

Inorganic microparticles differ from inorganic fillers, which have a BET specific surface area of ≤20 $m^2/g$, in having a BET specific surface area of ≥100 $m^2/g$ (BET measurement to DIN ISO 9277:2003-05).

Preference for use as inorganic microparticles is given to bentonite, colloidal silica, silicates and/or calcium carbonate.

Bentonite refers in general to sheet-silicates that are swellable in water. These are, in particular, the clay mineral montmorillonite and also similar clay minerals such as nontronite, hectorite, saponite, sauconite, beidellite, allevardite, illite, halloysite, attapulgite and sepiolite. These sheet-silicates are preferably activated, i.e., converted into a water-swellable form, before use by treating the sheet-silicates with an aqueous base such as aqueous solutions of sodium hydroxide, potassium hydroxide, sodium carbonate or potassium carbonate.

The bentonite used as inorganic microparticles has preferably been treated with aqueous sodium hydroxide solution. The platelet diameter of bentonite dispersed in water after treatment with aqueous sodium hydroxide solution is, for example, in the range from 1 to 2 μm, platelet thickness is about 1 nm. Depending on its type and mode of activation, bentonite has a specific surface area of 150 to 800 $m^2/g$. Typical bentonites are described for example in EP-B-0235893. In the papermaking process, the bentonite added to the cellulose suspension is typically in the form of an aqueous slurry of bentonite. This bentonite slurry may comprise up to 10 wt % of bentonite. The bentonite content of the slurries is normally about 3-5 wt %.

As colloidal silica there may be used products from the group of silicon-based particles, silica microgels, silica sols, aluminosilicates, borosilicates, polyborosilicates or zeolites. These have a specific surface area of 200-100/$m^2/g$ and an average distribution of 1-250 nm, normally in the range 40-100 nm, for the particle size. The preparation of such components is described for example in EP-A-0041056, EP-A-0185068 and U.S. Pat. No. 5,176,891.

Clay or else kaolin is a water-containing aluminosilicate of platelet-shaped structure. The crystals have a layered structure and an aspect ratio (ratio of diameter to thickness) of up to 30:1. Particle size is not less than 50% below 2 μm.

When inorganic microparticles are used, it is preferable to choose a weight ratio of not less than 30:1 for filler to inorganic microparticles.

The solids content of the aqueous slurry is generally ≥3 wt %, preferably ≥8 wt %, especially ≥12 wt %, based on the aqueous slurry.

The proportion of microparticles in the aqueous slurry is for example 0.01-1 wt % based on filler solids. A microparticle fraction of 0.05-0.6 wt % based on filler solids is preferred.

The proportion of water-soluble amphoteric polymer is generally 0.01-1 wt %, preferably 0.05-0.6 wt % based on filler solids.

Preference is given to aqueous slurries comprising, preferably consisting of, water, 5-70 wt % of filler based on the aqueous slurry, and 0.001-1 wt % of water-soluble amphoteric polymer and 0.01-1 wt % of microparticle, all based on filler solids.

Preference is given to slurries in which the ratio of water-soluble amphoteric polymer to microparticle is in the range from 5:1 to 1:5, preferably from 3:1 to 1:3.

In the present invention, the aqueous slurry is added to a paper stock.

The paper stock used may be any softwood or hardwood fiber typically used in the paper industry, examples being mechanical pulp, bleached and unbleached chemical pulp, as well as paper stocks from any annual plants. Mechanical pulp includes for example groundwood, thermomechanical pulp (TMP), chemithermomechanical pulp (CTMP), pressure groundwood, semichemical pulp, high-yield pulp and refiner mechanical pulp (RMP). Sulfate, sulfite and soda chemical pulps may be used for example. Preference is given to using unbleached chemical pulp, also known as unbleached kraft pulp. Suitable annual plants for producing paper stocks include, for example, rice, wheat, sugar cane and kenaf. Furnishes can also be produced using wastepaper, which is either used alone or in admixture with other fibrous materials. The wastepaper may come from a de-inking process for example. However, the wastepaper to be used need not be subjected to such a process. It is further also possible to proceed from fibrous mixtures of a primary material and recycled coated broke.

According to the present invention, it is to an aqueous suspension of fiber that the aqueous slurry is added. This preferably takes place in the absence of other process chemicals customarily used in papermaking. The water-soluble amphoteric polymers may be added in the papermaking process at, for example, 0.01 to 1.00 wt %, based on dry fiber.

Typical application rates range for example from 0.1 to 10 kg, preferably from 0.3 to 4 kg of the water-soluble amphoteric polymer per metric ton of dry fiber. In most cases, the amounts which are used of amphoteric polymer range from 0.5 to 2.5 kg of polymer solids per metric ton of dry fiber.

The method of the present invention may utilize customary amounts of the typical papermaking process chemicals, e.g., retention aids, drainage aids, other dry strength enhancers such as, for example, starch, pigments, fillers, optical brighteners, defoamers, biocides and paper dyes. These materials are preferably not added to the furnish until after the fiber has been treated in the manner of the present invention.

A papermachine consists in schematic terms of the consecutive units: headbox, wire section, press section and dryer section. The dewatering effect within the wire section is achieved through mechanical forces (the force of gravity, centrifugal force). In addition, hydrodynamic measures are also employed. These generally cause a negative pressure to become established at the wires. These measures are particularly sensible once drainage has reached a degree where capillary effects begin to play a part in the wet web of paper.

According to the present invention, sheet formation in the wire section is carried on until the sheet of paper has a dry matter content of not less than 18 wt %, preferably 19 wt %, especially 20 wt %. Sheet formation in the wire section is preferably carried on until the sheet of paper has a dry matter content of not more than 25 wt %. In a preferred version, sheet formation in the wire section is carried on until the sheet of paper has a dry matter content in the range from 19 to 22 wt %.

In the press section, the moist fibrous web is couched by a suction pickup roll or static underpressure element onto the press felt. The office of the press felt is to transport the fibrous web through press nips in various modified forms. The dry matter content of the web is up to not more than 55 wt % depending on the design of the press section and the composition of the furnish. The dry matter content increases with the pressure exerted in the press on the passing paper web. The pressure and hence the dry matter content of the paper web can be varied in many papermachines between relatively wide limits.

The method of the present invention allows papermachine operation with fewer broken ends. The paper formed in the method has a distinctly enhanced initial wet web strength.

Percentages in the examples are by weight unless otherwise stated.

EXAMPLES

The degree of hydrolysis of the water-soluble amphoteric polymers was quantified by enzymatic analysis of the formates/formic acid released in the hydrolysis (test kit from Boehringer Mannheim).

The structural composition of the polymers was computed from the monomer mixture used, the degree of hydrolysis and the vinylamine/amidine ratio determined via $^{13}C$ NMR spectroscopy. The composition ratio is in mol %, unless otherwise stated.

Dry matter content is determined in accordance with DIN EN ISO 638 DE using the oven-drying method. The dry matter content of the sheet of paper is to be understood as meaning the ratio of the mass of a sample dried to constant mass at a temperature of (105±2)° C. under defined conditions, to the mass of the sample before drying. The dry matter content is reported as proportional parts by mass in percent.

The dry matter content of the total paper stock and of fiber is determined similarly to the determination of the dry matter content of the sheet of paper. This results in the reported total paper solids and fiber solids, respectively.

The K values were determined after H. Fikentscher, Cellulosechemie, volume 13, 48-64 and 71-74 under the conditions reported in each case. The particulars between parentheses indicate the solvent and the concentration of the polymer solution.

Solids contents were determined for the polymers by 0.5 to 1.5 g of the polymer solution being distributed in a 4 cm diameter tin lid and then dried at 140° C. in a circulating air drying cabinet for two hours. The ratio of the mass of the sample after drying under the above conditions to the mass at sample taking is the solids content of the polymer.

Ash content: ISO 2144

Average molecular weight $M_w$ is to be understood as meaning here, hereinabove and hereinbelow the mass-average molecular weight $M_w$ as determinable by light scattering. The molecular weight was determined on the nonhydrolyzed precursor.

Materials used:

bentonite (Hydrocol® from BASF)

colloidal silica (EKA NP from Akzo Nobel)

acrylamide-containing structured anionic microparticle (Telioform® M300 from BASF) retention aid: Percol® 540 from BASF SE) cationic polyacrylamide as 1 wt % solution Preparation of Slurries A1-A16

The following amphoteric polymers were used to prepare slurries:

TABLE 1

Water-soluble amphoteric polymers used

| Polymer | Composition vinylformamide units/acrylic acid units/vinylamine + amidine units | Average molecular weight [dalton] |
|---|---|---|
| P1 | 40/30/30 | 500 000 |
| P2 | 5/45/50 | 400 000 |
| P3 | 65/20/15 | 650 000 |
| P4 | 30/40/30 | 400 000 |
| P5 | 30/30/40 | 400 000 |
| P6 | 40/30/30 | 500 000 |

Slurry A1

0.7 g of a 12 wt % aqueous solution of polymer P1 were initially charged to a glass beaker and then diluted with 30 g of water. This was followed by the admixture of 150 g of a 20 wt % slurry of precipitated calcium carbonate (PCC) in water. During the admixture of the PCC slurry and thereafter, the mixture was stirred with a Heiltof stirrer at 1000 revolutions per minute (rpm). About 30 seconds after the admixture of the PCC slurry, a 1 wt % slurry of bentonite (Hydrocol from BASF) was admixed under agitation from the stirring assembly. The admixed amount of bentonite slurry was reckoned such that the proportion of bentonite solids corresponded to 0.3 wt % based on FCC solids. Following a further 30 seconds, the speed of the Heiltof stirrer was reduced to 200 rpm. The bentonite slurry was prepared in accordance with the recommendations in the Hydrocol technical infosheet for service as a microparticle component to augment flocculation processes. This applies particularly to sufficiently swelling the bentonite before use. Mixture pH is subsequently adjusted to 8.5.

Slurries A2-A8

The preparation of slurry A1 was repeated using microparticles and the P2 to P6 polymers indicated in table 1 but maintaining the amounts/concentrations. Slurry 6 was prepared with ground calcium carbonate instead of precipitated calcium carbonate. The compositions of the slurries obtained are reported in table 2.

TABLE 2

Preparation of slurries

| Slurry | Polymer | Filler | Microparticle |
|---|---|---|---|
| A1 | P1 | PCC | bentonite |
| A2 | P2 | PCC | bentonite |
| A3 | P3 | PCC | bentonite |
| A4 | P4 | PCC | bentonite |
| A5 | P5 | PCC | bentonite |
| A6 | P6 | GCC | bentonite |
| A7 | P6 | PCC | silica sol |
| A8 | P2 | PCC | silica sol |

PCC: precipitated calcium carbonate
GCC: ground calcium carbonate

Slurry A9

0.7 g of a 12 wt % aqueous solution of polymer P6 were initially charged to a glass beaker and then diluted with 30 g of water. This was followed by the admixture of 150 g of a 20 wt % slurry of precipitated calcium carbonate (PCC) in water. During the admixture of the PCC slurry and thereafter, the mixture was stirred with a Heiltof stirrer at 1000 revolutions per minute (rpm). About 30 seconds after the admixture of the PCC slurry, a 1 wt % solution of an acrylamide-containing structured anionic micropolymer (Telioform M300 from BASF) was admixed under agitation from the stirring assembly. The admixed amount of micropolymer solution was reckoned such that the proportion of micropolymer solids in the PCC slurry corresponded to 0.07 wt % based on FCC solids. Following a further 30 seconds, the speed of the Heiltof stirrer was reduced to 200 rpm and left at that level until the further use of the slurry. Mixture pH is subsequently adjusted to 8.5.

Slurry A10

The preparation of slurry A9 was repeated except that polymer P2 was used instead of polymer P6.

Slurry A11

9 g of a 1 wt % slurry of bentonite (Hydrocol from BASF) was initially charged to a glass beaker. The bentonite slurry was prepared in accordance with the recommendations in the Hydrocol technical infosheet for service as a microparticle component to augment flocculation processes. This was followed by the admixture of 150 g of a 20 wt % slurry of precipitated calcium carbonate (PCC) in water. The ratio of bentonite solids to PCC solids in the resulting slurry was 3:1000. During the admixture of the PCC slurry and thereafter, the mixture was stirred with a Heiltof stirrer at 1000 revolutions per minute (rpm). About 30 seconds after the admixture of the PCC slurry, 21 g of a 0.4 wt % aqueous solution of polymer P6 was admixed under agitation from the stirring assembly. Following a further 30 seconds, the speed of the Heiltof stirrer was reduced to 200 rpm and left at that level until the further use of the slurry. Mixture pH is subsequently adjusted to 8.5.

Slurries A12-A14

The preparation of slurry A1 was repeated using microparticles and the P polymers indicated in table 1 but maintaining the amounts/concentrations. Slurry A16 was prepared with ground calcium carbonate instead of precipitated calcium carbonate. The compositions of the slurries obtained are reported in table 3.

TABLE 3

Preparation of slurries

| Slurry | Polymer | Filler | Microparticle | Microparticle [g] |
|---|---|---|---|---|
| A11 | P6 | PCC | bentonite | 0.09 |
| A12 | P2 | PCC | bentonite | 0.09 |
| A13 | P6 | PCC | silica sol | 0.09 |
| A14 | P2 | PCC | silica sol | 0.09 |

PCC: precipitated calcium carbonate

Slurry A15

21 g of a 0.1 wt % solution of an acrylamide-containing structured anionic micropolymer (M300 from BASF) was initially charged to a glass beaker. This was followed by the admixture of 150 g of a 20 wt % slurry of precipitated calcium carbonate (PCC) in water. The ratio of micropolymer solids to PCC solids in the resulting slurry was 0.7:1000. During the admixture of the PCC slurry and thereafter, the mixture was stirred with a Heiltof stirrer at 1000 revolutions per minute (rpm).

About 30 seconds after the admixture of the PCC slurry, 21 g of a 0.4 wt % aqueous solution of polymer P6 was admixed under agitation from the stirring assembly. Following a further 30 seconds, the speed of the Heiltof stirrer was reduced to 200 rpm and left at that level until the further use of the slurry. Mixture pH is subsequently adjusted to 8.5.

Slurry A16

The preparation of slurry A15 was repeated except that polymer P2 was used instead of polymer P6.

Slurry A17 (Not in Accordance with the Present Invention)

The preparation of slurry A1 was repeated except that no microparticles were added.

Slurry A18 (Not in Accordance with the Present Invention)

The preparation of slurry A2 was repeated except that no microparticles were added.

Slurry A19 (Not in Accordance with the Present Invention)

The preparation of slurry A11 was repeated except that no water-soluble amphoteric polymer was added.

Pretreatment of Fibrous Suspension

A mixture of bleached birchwood sulfate and bleached pinewood sulfate in a ratio of 70/30 was beaten in a laboratory pulper at a solids concentration of 4 wt % to a freeness of 29-32 and freedom from fiber bundles. The fibrous stuff pH was in the range from 7 to 8 at this stage. The beaten stuff was subsequently diluted with water to a solids concentration of 0.8 wt %. The dilute fibrous stuff was subsequently admixed with an optical brightener (Blankophor PSG) and also with a cationic starch (HiCat 5163 A).

The cationic starch had been destructurized beforehand as a 10 wt % starch slurry in a jet cooker at 130° C. for 1 minute. The amount of optical brightener added was 0.3 wt % of commercial product, based on total paper stock solids. The amount of cationic starch added was 0.8 wt % of starch solids, based on total paper stock solids.

Production of Sheets of Paper by the Method of the Invention:

To determine the performance of the above-described aqueous slurries in the production of filler-containing papers, each dilute paper stock suspension was initially charged at 500 ml and admixed with a cationic polyacrylamide (Percol) as retention aid plus in each case one of the filler slurries described in the inventive and comparative examples. The amount of retention aid added was 0.01 wt % of Percol based on total paper stock solids. The amount of filler slurry added to the paper stock suspension was adjusted in several preliminary tests such that the ash content of the sheets of paper fabricated from furnish plus slurry was 25 wt %.

Sheets produced for comparison each comprise about 25 wt % of an untreated PCC and also 25 wt % of an untreated GCC.

The sheets of paper were produced at a basis weight of 100 g/m$^2$ on a dynamic sheet-former from TechPap of France. The paper stock suspension was sprayed onto a wire clamped into an upright fast-rotating drum. Drainage and sheet formation in this system is determined not only by the sheet structure but particularly by the centrifugal forces within the rotating drum. The speed of rotation of the drum can be varied to likewise vary the centrifugal force acting on the nascent sheet structure. The result is a variation in sheet drainage that leads to a variation in the dry matter content of the wet paper web. The reference is here to the dry matter content of the wet paper web immediately after removal from a water-permeable support (wire) clamped into the drum of the dynamic sheet-former.

The speed of the drum was varied in 5 stages between 600 and 1100 revolutions per minute, making it possible to establish dry matter contents in the range between 14 wt % and 21 wt %. The filler quantity admixed for sheet formation has to be slightly increased with increasing drum speed, since filler retention decreases with increasing drainage. A small portion of the still wet sheet web is used for immediate determination of the dry matter content after removal of the wet paper sheet from the wire of the dynamic sheet-former.

Performance Testing:

Determination of Initial Wet Web Strength

The initial wet web strength must not be confused with a paper's wet strength and initial wet strength, since both properties are measured on dried paper remoistened back to a defined water content. Initial wet strength is an important parameter in assessing paper that does not have permanent wet strength. Paper that has been dried and remoistened has a completely different wet strength than moist as-produced paper after passing through the wire and press sections of the papermachine.

Initial wet web strength is determined on wet paper using in each case the Voith method (cf. M. Schwarz and K. Bechtel "Initiale Gefügefestigkeit bei der Blattbildung", in Wochenblatt für Papierfabrikation 131, pages 950-957 (2003) No. 16). The wet sheets after pressing in the static press were knocked off onto a plastics support and transferred to a cutting support. Test strips having a defined length and width were then cut out of the sheet They were pressed under constant pressure until the desired dry matter content was reached. To investigate the sheets of paper obtained according to the examples reported above, four dry matter contents ranging between 42% and 58% were established in each case. These values were used to determine initial wet web strength at 50% dry matter using a fitting method described in the abovementioned literature reference. The actual measurement of initial wet web strength took place on a vertical tensile tester using a special clamping device. The force determined in the tension machine was converted into the grammage-independent IWWS index. For an exact description of the clamping device, the measuring procedure, the determination of the dry matter in the paper and the data processing, the abovementioned literature reference can be enlisted.

The results of the tests are reported in table 4.

TABLE 4

| Example | Slurry | Dry matter content before press [wt %] | IWWS(50%) index [Nm/g] |
|---|---|---|---|
| reference PCC 1 | PCC untreated | 14.6 | 1.8 |
| reference PCC 2 | PCC untreated | 15.3 | 1.7 |
| reference PCC 3 | PCC untreated | 17.1 | 2.1 |
| reference PCC 4 | PCC untreated | 18.6 | 1.9 |
| reference PCC 5 | PCC untreated | 19.5 | 1.7 |
| reference GCC 6 | GCC untreated | 14.9 | 2.1 |
| reference GCC 7 | GCC untreated | 16.1 | 2.0 |
| reference GCC 8 | GCC untreated | 17.8 | 1.8 |
| reference GCC 9 | GCC untreated | 18.6 | 1.7 |
| reference GCC 10 | GCC untreated | 19.4 | 1.9 |
| 1 | 1 | 14.8 | 2.4 |
| 2 | 1 | 15.7 | 2.2 |
| 3 | 1 | 17.2 | 2.4 |
| 4E | 1 | 18.3 | 3.9 |
| 5E | 1 | 19.5 | 4.2 |
| 6 | 2 | 15.3 | 2.2 |
| 7 | 2 | 16.8 | 2.4 |
| 8 | 2 | 17.5 | 2.5 |
| 9E | 2 | 18.2 | 3.6 |
| 10E | 2 | 19.4 | 3.9 |
| 11 | 3 | 15.5 | 1.9 |
| 12 | 3 | 16.2 | 2.3 |
| 13 | 3 | 17.6 | 2.6 |

TABLE 4-continued

| Example | Slurry | Dry matter content before press [wt %] | IWWS(50%) index [Nm/g] |
|---|---|---|---|
| 14E | 3 | 18.4 | 3.4 |
| 15E | 3 | 20.1 | 3.8 |
| 16 | 4 | 15.3 | 2.1 |
| 17 | 4 | 15.9 | 2.1 |
| 18 | 4 | 17.4 | 2.4 |
| 19E | 4 | 18.5 | 3.6 |
| 20E | 4 | 19.7 | 3.8 |
| 21 | 5 | 14.9 | 2.1 |
| 22 | 5 | 16.3 | 2.4 |
| 23 | 5 | 17.2 | 2.3 |
| 24E | 5 | 18.9 | 3.6 |
| 25E | 5 | 19.8 | 3.7 |
| 26 | 6 | 15.8 | 2.2 |
| 27 | 6 | 16.5 | 2.3 |
| 28 | 6 | 17.3 | 2.7 |
| 29E | 6 | 18.7 | 4.1 |
| 30E | 6 | 19.5 | 4.5 |
| 31 | 7 | 15.2 | 2.3 |
| 32 | 7 | 16.6 | 2.3 |
| 33 | 7 | 17.4 | 2.6 |
| 34E | 7 | 18.6 | 3.5 |
| 35E | 7 | 19.4 | 3.8 |
| 36 | 8 | 14.5 | 1.9 |
| 37 | 8 | 15.3 | 2.4 |
| 38 | 8 | 16.8 | 2.4 |
| 39E | 8 | 18.3 | 3.6 |
| 40E | 8 | 19.5 | 3.7 |
| 41 | 9 | 15.6 | 2.1 |
| 42 | 9 | 16.4 | 2.1 |
| 43 | 9 | 17.3 | 2.2 |
| 44E | 9 | 18.3 | 3.6 |
| 45E | 9 | 19.6 | 3.5 |
| 46 | 10 | 15.6 | 1.8 |
| 47 | 10 | 16.4 | 2.1 |
| 48 | 10 | 17.3 | 2.3 |
| 49E | 10 | 18.7 | 3.4 |
| 50E | 10 | 19.6 | 3.7 |
| 51 | 11 | 15.7 | 2.2 |
| 52 | 11 | 16.4 | 2.2 |
| 53 | 11 | 17.7 | 2.4 |
| 54E | 11 | 18.6 | 3.6 |
| 55E | 11 | 19.9 | 3,7 |
| 56 | 12 | 14.8 | 2.2 |
| 57 | 12 | 16.1 | 2.3 |
| 58 | 12 | 17.1 | 2.6 |
| 59E | 12 | 18.2 | 3.5 |
| 60E | 12 | 18.9 | 3.8 |
| 61 | 13 | 15.2 | 2.3 |
| 62 | 13 | 16.7 | 2.4 |
| 63 | 13 | 17.6 | 2.7 |
| 64E | 13 | 18.6 | 3.8 |
| 65E | 13 | 19.4 | 4.0 |
| 66 | 14 | 15.3 | 2.1 |
| 67 | 14 | 16.4 | 2.3 |
| 68 | 14 | 17.3 | 2.3 |
| 69E | 14 | 18.4 | 3.5 |
| 70E | 14 | 19.3 | 3.9 |
| 71 | 15 | 14.8 | 2.0 |
| 72 | 15 | 15.6 | 2.1 |
| 73 | 15 | 16.9 | 2.4 |
| 74E | 15 | 18.4 | 3.5 |
| 75E | 15 | 19.1 | 3.5 |
| 76 | 16 | 15.4 | 1.8 |
| 77 | 16 | 16.6 | 2.1 |
| 78 | 16 | 17.6 | 2.4 |
| 79E | 16 | 18.4 | 3.3 |
| 80E | 16 | 19.6 | 3.6 |
| 81 | 17 | 16.1 | 2.2 |
| 82 | 17 | 16.9 | 2.2 |
| 83 | 17 | 17.3 | 2.3 |
| 84 | 17 | 18.7 | 2.3 |
| 85 | 17 | 19.8 | 2.4 |
| 86 | 18 | 15.7 | 2.1 |
| 87 | 18 | 16.4 | 2.4 |
| 88 | 18 | 17.2 | 2.3 |
| 89 | 18 | 18.4 | 2.5 |
| 90 | 18 | 19.3 | 2.4 |
| 91 | 19 | 15.6 | 2.2 |
| 92 | 19 | 16.7 | 2.1 |
| 93 | 19 | 17.8 | 2.4 |
| 94 | 19 | 18.6 | 2.2 |
| 95 | 19 | 19.7 | 2.3 |

Examples in accordance with the present invention are all marked "E" in the table.

The following inferences can be drawn from the data listed in table 4:

The examples conducted in accordance with the present invention exhibit a distinctly enhanced wet web strength index IWWS (50%) for the sheets. When the dry matter content is clearly therebelow, the IWWS (50%) index is only slightly above that of an untreated filler slurry.

Reference examples PCC 4 and PCC 5 and reference examples GCC 9 and GCC 10 show that just adjusting the dry matter content to above 18 wt % (in the case via the adjustment of the speed of rotation of the dynamic sheet-former) without additional treatment of the filler slurry with a 2-component system does not lead to a significant increase in the IWWS (50%) index. Examples 84, 85, 89, 90, 94 and 95 show that treating the filler with either just the water-soluble amphoteric polymer or just the microparticles likewise fails to cause any effect on exceeding the dry matter content above 18%.

We claim:

1. A method of producing paper and board, said method comprising providing an aqueous slurry comprising a filler, at least one water-soluble amphoteric polymer and a microparticle, admixing the aqueous slurry to a paper stock, dewatering the paper stock by sheet formation in a wire section to obtain a paper sheet, until the paper sheet has a dry matter content of not less than 18 wt %, and then pressing the paper sheet and drying, wherein the water-soluble amphoteric polymer is obtained by a process comprising copolymerizing a monomer mixture comprising a) at least one N-vinylcarboxamide of formula

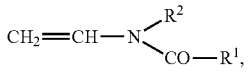

(I)

where $R^1$ and $R^2$ are each independently H or a $C_1$ to $C_6$ alkyl, b) at least one monoethylenically unsaturated monomer having at least one free acid group or at least one acid group in salt form, c) optionally at least one monoethylenically unsaturated monomer other than said components (a) and (b), and d) optionally at least one compound having two or more ethylenically unsaturated double bonds, and then partly or wholly hydrolyzing the —CO—$R^1$ groups of the polymer, wherein cationic monomer units and anionic monomer units differ in respective molar fractions, each based on a total number of moles of all monomer units, by not more than 10 Mol % in absolute terms;

wherein the filler is calcium carbonate; and wherein the microparticle is chosen from:

a copolymer formed from acrylamide and one or more anionic monomers; and/or inorganic microparticles of bentonite, colloidal silica, and/or silicate.

2. The method according to claim 1, wherein the monomer mixture consists of: based on a total weight of monomers in the monomer mixture, a) 5 to 95 wt %, of least one N-vinylcarboxamide b) 5 to 95 wt %, of the at least one monoethylenically unsaturated monomer having at least one free acid group or at least one acid group in salt form, c) 0 to 90 wt % of the at least one monoethylenically unsaturated monomer other than said components (a) and (b), and d) 0 to 5 wt % of the at least one compound having two or more ethylenically unsaturated double bonds.

3. The method according to claim 1, wherein the water-soluble amphoteric polymer is obtained by copolymerizing a) N-vinylformamide, b) at least one monoethylenically unsaturated monomer selected from the group consisting of acrylic acid, methacrylic acid, an alkali metal salt of acrylic acid and/or methacrylic acid and an ammonium salt of acrylic acid and/or methacrylic acid, and c) optionally other monoethylenically unsaturated monomers.

4. The method according to claim 1, wherein the water-soluble amphoteric polymer comprises (i) 1 to 98 mol % of vinylcarboxamide units, (ii) (ii) 1 to 98 mol % of units of monoethylenically unsaturated sulfonic acids, phosphonic acids, phosphoric esters, derivatives thereof or units of monoethylenically unsaturated mono- and dicarboxylic acids, thereof and dicarboxylic anhydrides, (iii) 1 to 98 mol % of vinylamine units and/or amidine units, and (iv) (iv) up to 50 mol % of units of other monoethylenically unsaturated compounds.

5. The method according to claim 1, wherein the water-soluble amphoteric polymer comprises (i) 5 to 70 mol % of vinylcarboxamide units, (ii) 5 to 45 mol % of units of acrylic acid, methacrylic acid, a salt of acrylic acid and/or a salt of methacrylic acid, and (iii) 10 to 60 mol % of units form vinylamine units and optionally amidine units.

6. The method according to claim 1, wherein a proportion of the microparticles in the aqueous slurry is 0.01-1 wt % based on the filler.

7. The method according to claim 1, wherein a proportion of the water-soluble amphoteric polymer is 0.01-1 wt %, based on the filler.

8. The method according to claim 1, wherein the aqueous slurry comprises water, 5-70 wt % of the filler based on the aqueous slurry, 0.001-1 wt % of the water-soluble amphoteric polymer based on the filler, and 0.01-1 wt % of the microparticles based on the filler.

9. The method according to claim 1, wherein the sheet formation in the wire section is carried on until the paper sheet has a dry matter content of not less than 19 wt %.

* * * * *